US007690060B2

(12) United States Patent
Rodrigues Moreira

(10) Patent No.: US 7,690,060 B2
(45) Date of Patent: Apr. 6, 2010

(54) ARTICULATED MATTRESS

(76) Inventor: Victor Manuel Rodrigues Moreira, Rua das Indústrias, nº. 3298, Lantemil, P-4785-626 Trofa Santiago do Bougado (PT)

( * ) Notice: Subject to any disclaimer, the term of this patent is extended or adjusted under 35 U.S.C. 154(b) by 360 days.

(21) Appl. No.: 11/587,768

(22) PCT Filed: Sep. 30, 2004

(86) PCT No.: PCT/IB2004/003191

§ 371 (c)(1),
(2), (4) Date: Jan. 25, 2007

(87) PCT Pub. No.: WO2005/117656

PCT Pub. Date: Dec. 15, 2005

(65) Prior Publication Data

US 2008/0028535 A1 Feb. 7, 2008

(30) Foreign Application Priority Data

May 28, 2004 (PT) ..... 103128

(51) Int. Cl.
*A47B 7/02* (2006.01)

(52) U.S. Cl. ..... 5/618; 5/617; 5/613; 5/722

(58) Field of Classification Search ..... 5/617, 5/618, 722, 411, 613
See application file for complete search history.

(56) References Cited

U.S. PATENT DOCUMENTS

| | | | | |
|---|---|---|---|---|
| 2,631,300 A | | 3/1953 | Murray | |
| 3,644,946 A | | 2/1972 | Swatt | |
| 4,336,621 A | * | 6/1982 | Schwartz et al. | 5/658 |
| 5,640,730 A | | 6/1997 | Godette | |
| 6,742,205 B2 | * | 6/2004 | Dewert | 5/618 |
| 2002/0162170 A1 | * | 11/2002 | Dewert | 5/617 |
| 2005/0210588 A1 | * | 9/2005 | Loewenthal | 5/618 |
| 2006/0143827 A1 | * | 7/2006 | Wilming et al. | 5/618 |
| 2007/0220677 A1 | * | 9/2007 | Dewert | 5/618 |

FOREIGN PATENT DOCUMENTS

| | | |
|---|---|---|
| DE | 199 08 083 C1 | 10/2000 |
| WO | 02/076267 | 10/2002 |

* cited by examiner

*Primary Examiner*—Darnell Jayne
*Assistant Examiner*—William Kelleher
(74) *Attorney, Agent, or Firm*—Wenderoth, Lind & Ponack, L.L.P.

(57) ABSTRACT

The present invention refers to an articulated mattress that does not need any specific frame for its perfect functioning, mattress that may be provided with a massage device, pertaining to the general market, having particular application in the field of health and prevention and being included in the group of products that provide comfort and wellbeing. The said mattress is characterized in that it is articulated, in that it is provided with an internal support structure of the plate and of the cushion and with an external stabilization structure, the internal structure comprised by a superior element, an inferior element and a central element, the external structure being connected to the other two elements by means of joints and having at least two supports for pivoted fixation of the elevation mechanisms responsible for the movement, independently, of the superior element and of the inferior element, the internal structure being, in turn, connected to the external structure by means of, at least, a foot with which is provided the central element, connection that is of the removable type.

7 Claims, 8 Drawing Sheets

ARTICULATED MATTRESS

FIELD OF THE INVENTION

This invention relates to an articulated mattress that does not need any specific frame for its perfect functioning, and a mattress that may be provided with a massage device.

The mattress invented pertains to, to the market as a whole, without restrictions, being included in the group of products that provide comfort and wellbeing, having particular application in the area of health and prevention, and may be used advantageously in the case of bed-ridden people or in convalescence, or for purposes of therapeutic and/or orthopaedic treatments and, therefore, it is destined, in particular, given the advantages that it presents when compared to the known solutions, to equip hospitals, retirement homes and care centres, among others.

DESCRIPTION OF RELATED ART

Several articulated beds are know of mechanical or electric operation, the use of beds with a mechanical system of operation, of the bed frame by means of a lever being common in hospitals.

Also known are several articulated frames, being, electrically operated, the mattresses that lay on such frames folding accordingly to the movement of those frames.

However, there is no knowledge of any articulated mattress and, consequently, even less of articulated mattress with the innovating technical characteristics that this invention presents, which are described below in detail, characteristics that provide it with a set of noteworthy advantages when compared with the known devices.

One advantage of the present invention is the great easiness of use and the safety, since there is no risk of getting a finger or a hand trapped when the mattress is operated, for example through an electric control, risk that is present in the case of the articulated frames.

It is known that, in what concerns the bed-ridden people, are indispensable the cares with the body, namely with the blood flow, bearing in mind the great immobility of these people's condition, under penalty of that state of immobility motivating, for example, chronic wounds.

The present invention does not only provide physical wellbeing particularly to these people, acting on the patient's systems of blood and lymphatic flow, but it also provides psychological wellbeing—by rule of great importance in the recovery of the patients—since for the patient to be able to take advantage of that double wellbeing, it is enough to have the mattress of his bed replaced for the one that is object of the present invention, without need to replace the bed, not changing the surroundings of the patient.

It should also be noted that the internal and external structure of the mattress, that characterise it, do not limit its shape, which may be the traditional, that is, rectangular, or other less conventional, as for example the circular, the oval, heart shaped, or other, either it is a single person mattress or a mattress for couple.

BRIEF SUMMARY OF THE INVENTION

The present invention refers to an articulated mattress provided with an internal structure of support of the plate and of the cushion and with and external structure of stabilisation, the internal structure composed by a superior element (i.e., an upper frame element), by a inferior element (i.e., a lower frame element) and by a central element (i.e., a central frame element), the other two elements being connected to this one by means of joints.

The central element is provided with, at least, two supports for pivoting fixation of the elevation mechanisms responsible for the movement, independently, of the superior element and of the inferior element.

The internal structure is, in turn, connected to the external structure by means of, at least, a foot with which the central element is provided, connection that is of the removable type.

The central element may be tubular and comprised by two rails, having joints at the extremities, and by two crossheads, connected, by the extremities, to those rails, the crossheads being provided with a reinforcement that unites them, thus being created a firm and fixed set.

Each crosshead is provided, at least, with a support for pivoting fixation of an elevation mechanism and each one of them may have two feet.

The connection of the central element to the superior element is made by means of joints that the rails have at the extremities.

The superior element comprises, besides a peripheral portion which may be tubular, a tilted longitudinal lever, integral with said portion and provided, at the extremity nearer the central element, with a pivoting connection to the telescopic arm of the elevation mechanism of the superior element, the extremity of the lever with pivoting connection is always closer to the ground than the other extremity, regardless of the position of the superior element.

The peripheral portion of the superior element of the internal structure may be reinforced by one crosshead, or more than one crosshead, whenever that is convenient, as in the case of a couple's mattress.

It may, additionally, be reinforced by a longitudinal element.

That portion, the longitudinal element and the crosshead are positioned in a common plane and are solidly connected among themselves, the crosshead being situated near the extremities of the said portion.

Moreover, the mentioned longitudinal element and the lever of the superior element may be connected by means of a connection piece—that is connected to the lever before its extremity by pivoting connection—forming a rigid triangle.

On the other hand, the inferior element of the internal structure may be equally tubular, comprised by a peripheral portion, continuous or interrupted by joints.

The extremities of that peripheral portion have connection with the central element at the joints that the rails have at the extremities.

The inferior element comprises, at least, a tilted longitudinal lever integral, directly, with the mentioned peripheral portion, or indirectly, resorting, in this case, to a crosshead or to a similar element, provided, at the extremity closer to the central element, with a pivoting connection to the telescopic arm of the elevation mechanism of the inferior element or of a part of this element.

As was stated above, the peripheral portion of the inferior element may be subdivided in several parts, particularly in two, being, in this case, the extreme part provided with joints with stop that allow the connection with the adjacent interior part.

This interior part is provided with a tilted longitudinal lever, integral with the peripheral portion of this part and provided, at the extremity closer to the central element, with a pivoting connection to the telescopic arm of the elevation mechanism of the inferior element, the extremity of the lever with pivoting connection being always closer to the ground than the other extremity, regardless of the position of the inferior element.

Still in the case the peripheral portion of the inferior element is subdivided in two parts, the extreme part may have a crosshead situated next to the joints with stop and the interior part may have, also next to those joints, a crosshead and another crosshead situated next to the joints that connect it to the central element, these two last crossheads being braced by a longitudinal element.

On the other hand, the peripheral portion of the interior part, those two crossheads and the longitudinal element must be positioned on a common plane and connect one another solidly.

Furthermore, that longitudinal element, the lever mentioned above and a connection piece between these two—that is connected to the lever before its extremity with pivoting connection—form a rigid triangle.

Bearing in mind the described before, it is understood that one could easily subdivide in three parts the peripheral portion of the inferior element of the articulated mattress.

Besides the already mentioned advantages, the mattress invented is robust and resistant and is provided with elevation mechanisms of smooth and silent operation and of easy maintenance.

With this invention is also facilitated the task of making the bed traditionally, that is, by folding the sheets and/or bed covers underneath the mattress, since it will not be necessary to lift up the mattress.

BRIEF DESCRIPTION OF THE SEVERAL VIEWS OF THE DRAWINGS

In the enclosed figures, presented as non-limiting examples, may be observed.

In particular the mentioned figures show.

Figure 1:
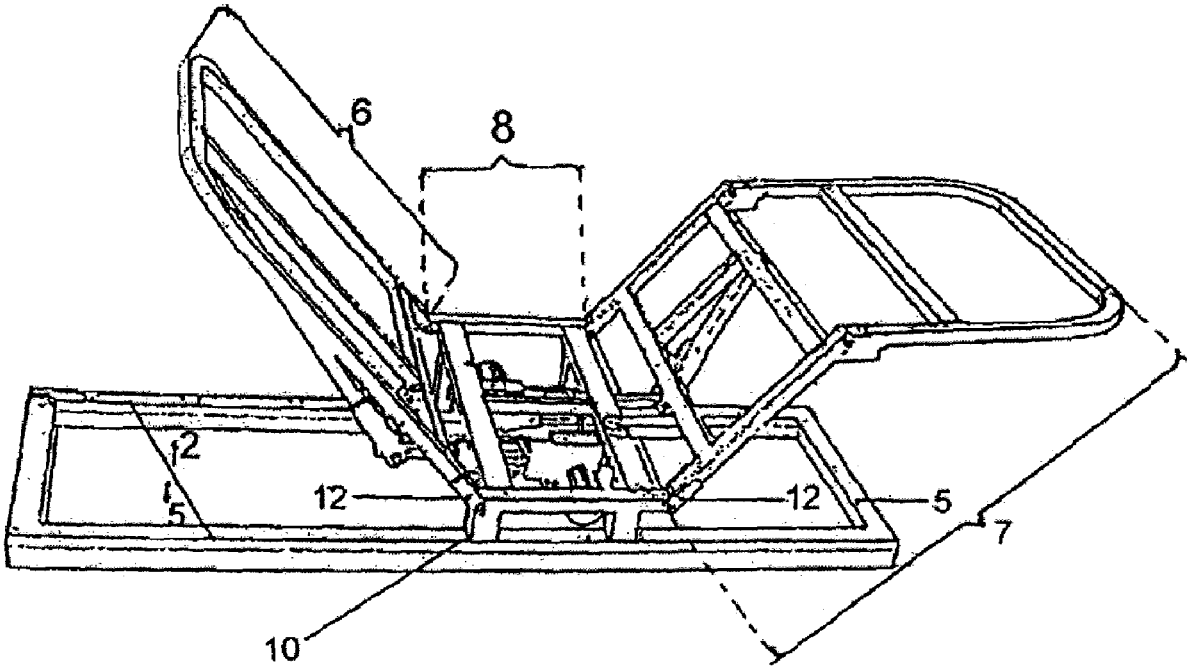
FIG. 1 shows in perspective, the upper side of the internal (of support) and external (of stabilisation) structures of the articulated mattress of the invention—these connected by means of four feet—both the superior element and the inferior element being in lifted position.
Figure 2:
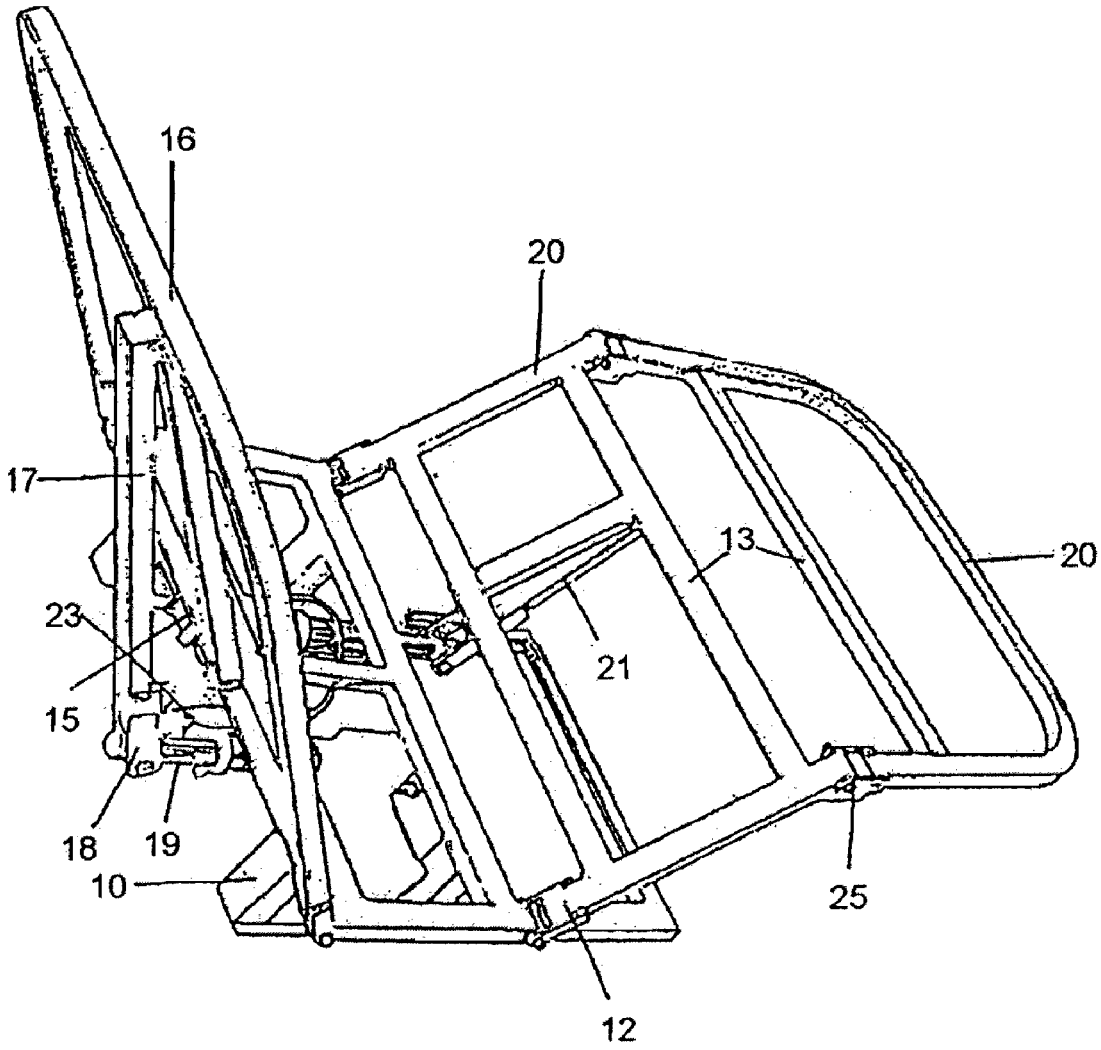
FIG. 2 shows, in perspective, the upper side of the internal support structure of the articulated mattress of the invention, being in lifted position both the superior element and the inferior element, this one comprised by two parts.
Figure 3:
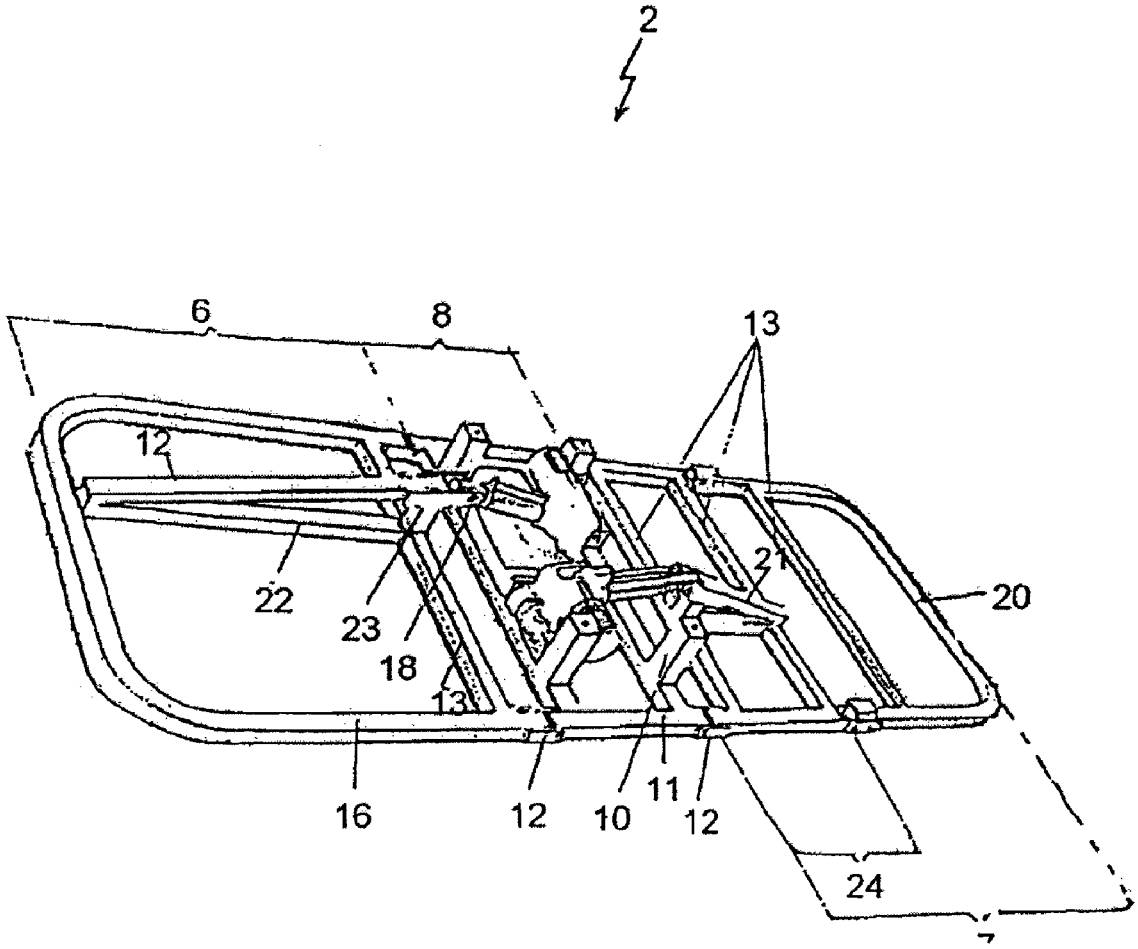
FIG. 3 shows, in perspective, the down side of the internal support structure of the articulated mattress of the invention, in horizontal position.
Figure 4:
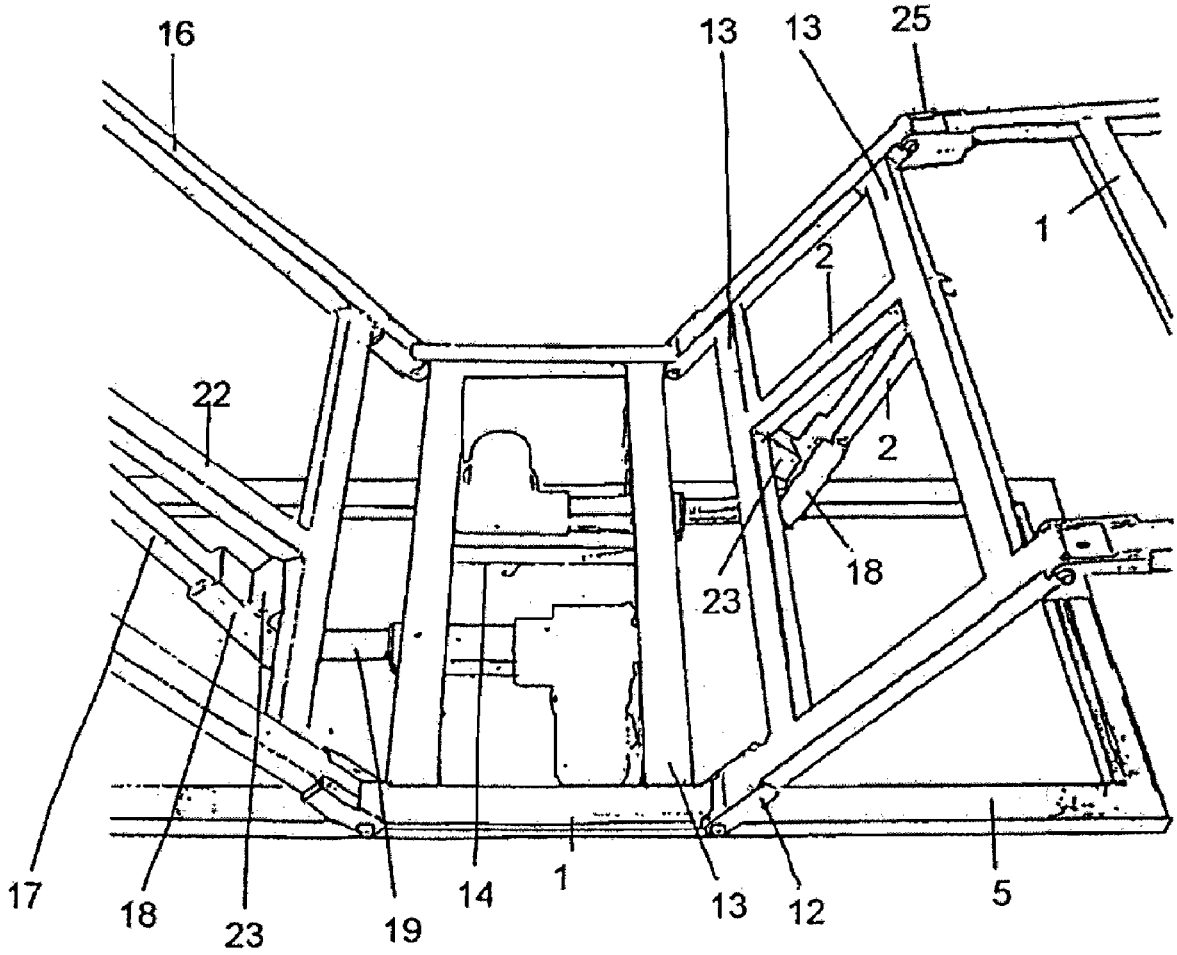
FIG. 4 shows, in perspective, the upper side of the internal (of support) and external (of stabilisation) structures of the articulated mattress of the invention, showing them not complete.
Figure 5:
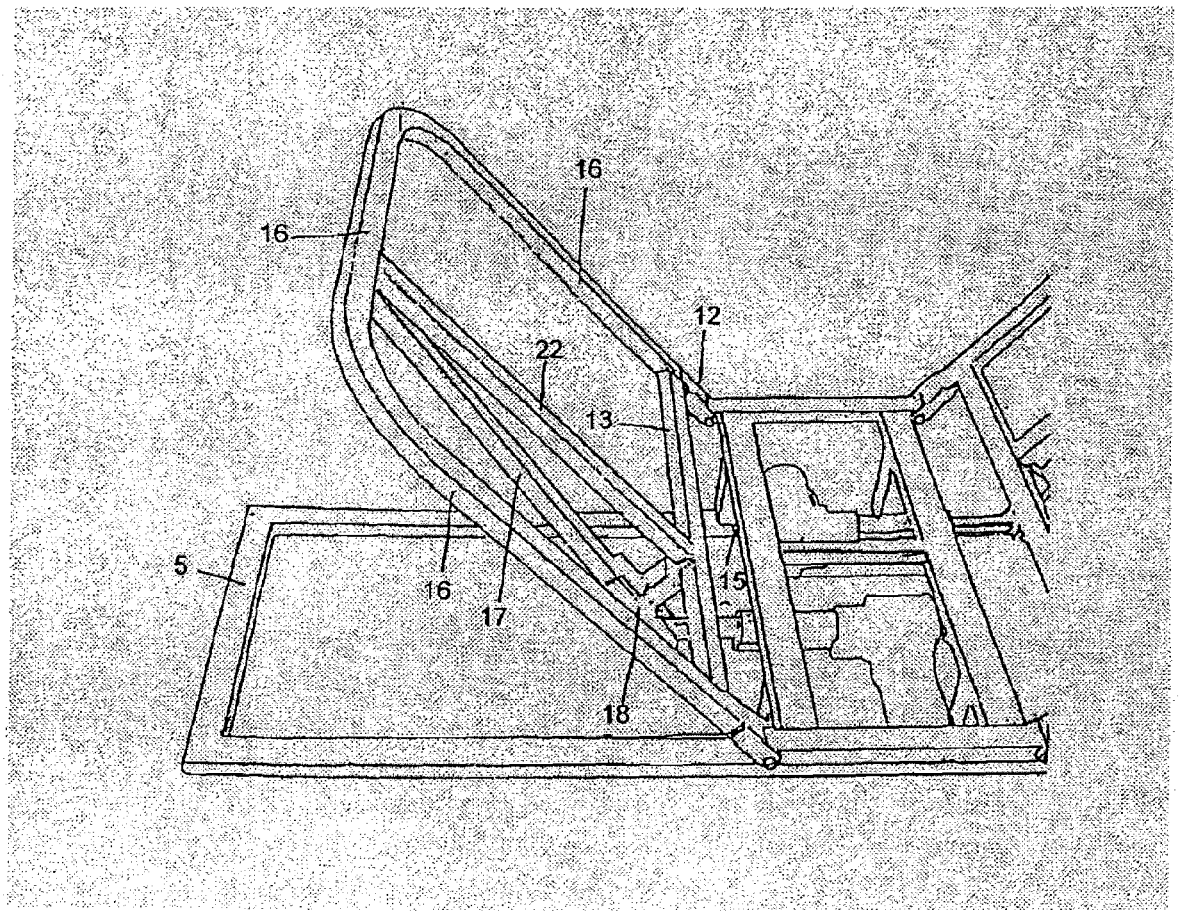
FIG. 5 shows, in perspective, the upper side of the internal (of support) and external (of stabilisation) structures of the articulated mattress of the invention, showing, in particular, the superior and central elements of the internal structure.
Figure 6:
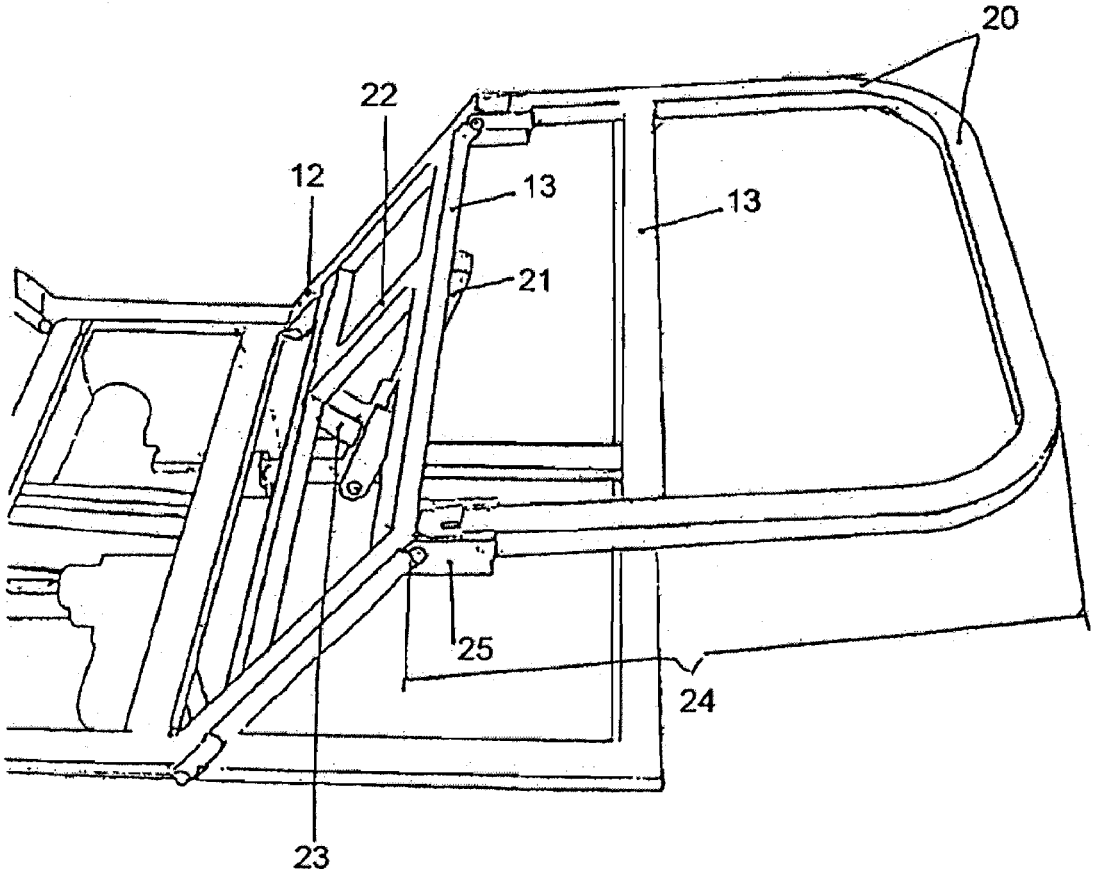
FIG. 6 shows, in perspective, the upper side of the internal (of support) and external (of stabilisation) structures of the articulated mattress of the invention, showing, in particular, the inferior element of the internal structure comprised by two parts.
Figure 7:
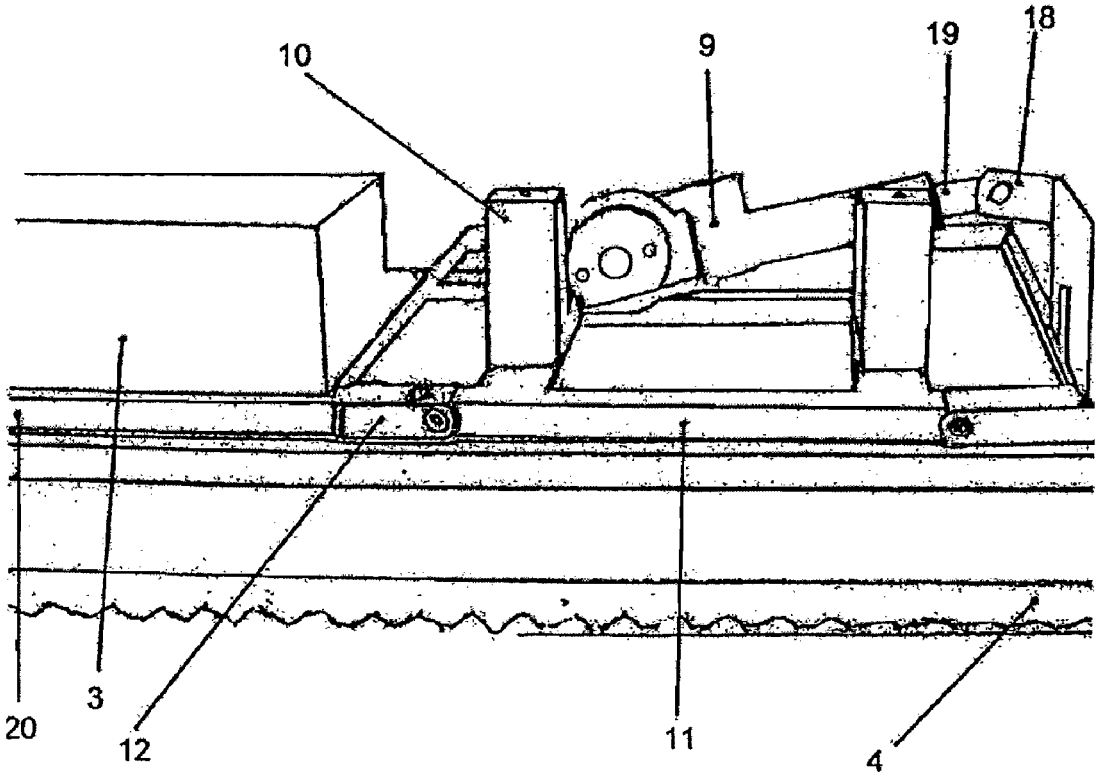
FIG. 7 shows, in perspective, the down side of the internal support structure of the plate and of the cushion of the articulated mattress of the invention, showing, in particular, the set formed by that structure and by those elements of stuffing, plate and cushion, at the zone of the central element.
Figure 8:
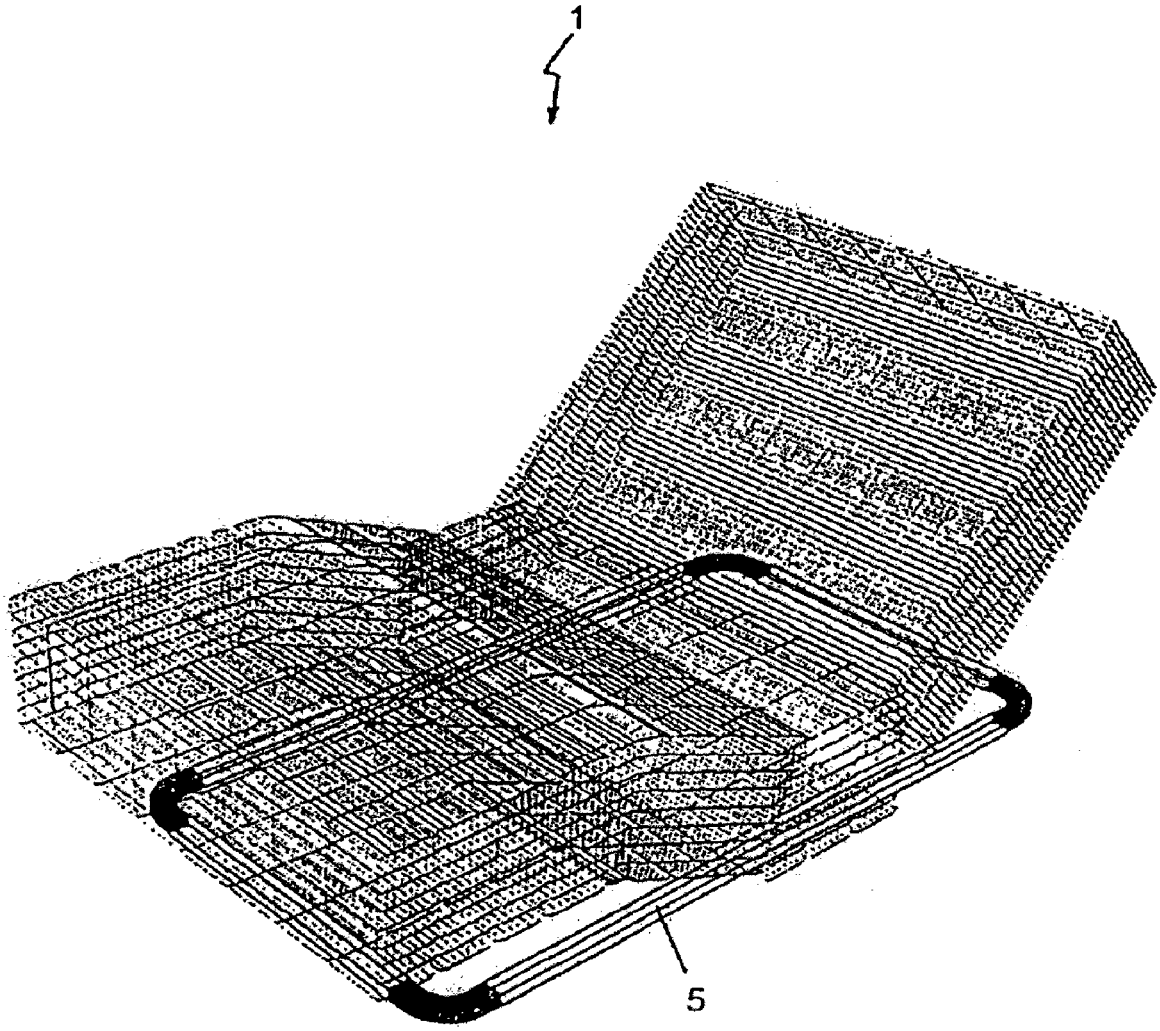
FIG. 8 shows, in perspective, the articulated mattress of the invention integrating an external stabilisation structure and an internal support structure—this one not visible in the figure as it is disposed inside the mattress body—whose inferior element is comprised by two parts, being in a lifted position, both this element and the superior element.

1—Articulated mattress
2—Internal support structure
3—Plate
4—Cushion
5—External stabilisation structure
6—Superior element
7—Inferior element
8—Central element
9—Elevation mechanism
10—Foot
11—Rail
12—Joint
13—Crosshead
14—Reinforcement
15—Support for elevation mechanism
16—Peripheral portion of the superior element
17—Lever integral with the superior element
18—Pivoting connection
19—Telescopic arm
20—Peripheral portion of the inferior element
21—Lever integral with the inferior element
22—Longitudinal element
23—Connection piece
24—Part
25—Joint with stop

DETAILED DESCRIPTION OF THE INVENTION

As was mentioned before, the articulated mattress of the invention may incorporate a massage device, being possible, for that effect, to resort to a cushion with notched profile (4) provided with multiple protuberances and concavities, those providing a massage of the digital type and serving these to house magnets that provide the creation of a magnetic field.

The plate (3) may be produced in latex, in stylatex or in another appropriate material.

In turn, the structure, either internal (2), or external (5), will be made, preferably, in iron, in aluminium or in plastic material, or combining such materials.

Furthermore, the internal structure (2) may be laminar ribbed and the external structure (5) must be flat, continuous—or discontinuous in the zone of the head and/or feet of the mattress—tubular or in bar, being circumscribed by the vertical projection of the exterior outline of the mattress and at a small distance of that outline.

On the other hand, the connection of the foot or feet (10) of the central element (8) to the external stabilisation structure (5) may be made by means of screws, plugs or fast fitting.

The plate (3) and the cushion (4), as well as their internal support structure (2) and the elevation mechanisms (9) are involved by a lining, preferably removable, with small openings at the zone of the feet (10).

The elevation mechanisms (9) must be operated through a device comprising a transformer and batteries—in case of electrical supply shortage the articulated mattress returns to the horizontal position—be fed by electric power of 24 V and have limiter switches and a safety fuse.

The elevation (9) and massage mechanisms and other integrated equipment, such as, for example, sound equipment, may be operated by means of a single remote control.

The invention claimed is:

1. An articulated mattress comprising:

a mattress body including a cushion;

an elevation mechanism;

an internal support structure supporting the cushion, the internal support structure being disposed inside the mattress body and including an upper frame element, a lower frame element, and a central frame element connected to the upper frame element by a first joint and connected to the lower frame element by a second joint, the central frame element including at least two supports for pivotably fixing the elevation mechanism to the central frame element; and an external stabilization structure disposed outside the mattress body for supporting the articulated mattress, wherein the central frame element is removably connected to the external stabilization structure by at least one foot, wherein the elevation mechanism is configured such that the upper frame element and the lower frame element are independently movable, wherein the elevation mechanism includes a telescoping arm, and the upper frame element includes (i) a tubular peripheral portion having a first distal end and a second distal end, the first distal end and the second distal end of the upper frame element being connected to the central frame element to form the first joint; and (ii) a longitudinal lever, the longitudinal lever including a first side integrally connected to the tubular peripheral portion and a second side pivotably connected to the telescoping arm, the second side being closer to the external stabilization structure than the first side, wherein the upper frame element further includes (i) a first cross member connecting two sides of the tubular peripheral portion, the first cross member being disposed proximate to the first distal end and the second distal end of the tubular peripheral portion;

(ii) a longitudinal element for reinforcing the upper frame element, the longitudinal element being connected to the first cross member and the tubular peripheral portion; and (iii) a connection piece, wherein the tubular peripheral portion, the first cross member, and the longitudinal element are arranged in a common plane, and wherein the longitudinal element, the longitudinal lever, and the connection piece are arranged to form a rigid triangle.

2. The articulated mattress according to claim 1, wherein the upper frame element includes a second cross member connecting two sides of the tubular peripheral portion.

3. An articulated mattress comprising:

a mattress body including a cushion;

an elevation mechanism;

an internal support structure supporting the cushion, the internal support structure being disposed inside the mattress body and including an upper frame element, a lower frame element, and a central frame element connected to the upper frame element by a first joint and connected to the lower frame element by a second joint, the central frame element including at least two supports for pivotably fixing the elevation mechanism to the central frame element; and an external stabilization structure disposed outside the mattress body for supporting the articulated mattress, wherein the central frame element is removably connected to the external stabilization structure by at least one foot, wherein the elevation mechanism is configured such that the upper frame element and the lower frame element are independently movable, wherein the elevation mechanism includes a telescoping arm, and the lower frame element includes (i) a peripheral portion having a first distal end and a second distal end, the first distal end and the second distal end being connected to the central frame element to form the second joint; and (ii) a tilted longitudinal lever including a first side integrally connected to one of the peripheral portion and a first cross member, the tilted longitudinal lever further including a second side pivotably connected to the telescoping arm, wherein the peripheral portion of the lower frame element includes a bottom-lower frame element and an intermediate-lower frame element, the bottom-lower frame element being movable relative to the intermediate-lower frame element, wherein the lower frame element includes a first connection and a second connection, the first connection and the second connection constituting a third joint connecting the bottom-lower frame element to the intermediate-lower frame element, one of the first connection and the second connection including a stop, and wherein the tilted longitudinal lever being connected to the intermediate-lower frame element, the second side of the tilted longitudinal lever being disposed closer to both the central frame element and the external stabilization structure than the first side of the titled longitudinal lever.

4. The articulated mattress according to claim 3, wherein:

the first cross member connects two sides of the intermediate-lower frame element, and the first cross member is disposed proximate to the third joint;

a second cross member connects the two sides of the intermediate-lower frame element, and the second cross member is disposed proximate to the second joint;

a third cross member connects two sides of the bottom-lower frame element, and the third cross member is disposed proximate to the third joint;

a longitudinal element connects the first cross member and the second cross member;

a connection piece connects the longitudinal element and the tilted longitudinal lever;

the peripheral portion of the lower frame element, the longitudinal element, the first cross member, and the second cross member is disposed in a common plane; and the connection piece, the longitudinal element, and the tilted longitudinal lever are arranged to form a rigid triangle.

5. An articulated mattress comprising:

a mattress body including a cushion;

an elevation mechanism;

an internal support structure supporting the cushion, the internal support structure being disposed inside the mattress body and including an upper frame element, a lower frame element, and a central frame element connected to the upper frame element by a first joint and connected to the lower frame element by a second joint, the central frame element including at least two supports for pivotably fixing the elevation mechanism to the central frame element; and an external stabilization structure disposed outside the mattress body for supporting the articulated mattress, wherein the central frame element is removably connected to the external stabilization structure by at least one foot, wherein the elevation mechanism is configured such that the upper frame element and the lower frame element are independently movable, wherein the central frame element of the internal support structure includes (i) a first central rail having an upper distal end and a lower distal end;

(ii) a second central rail having an upper distal end and a lower distal end; and (iii) a first cross member and a second cross member, each of the first cross member and the second cross member connecting the first central rail to the second central rail so as to reinforce the central frame element, wherein the at least two supports for pivotably fixing the elevation mechanism to the central frame element include a first support on the first cross member and a second support on the second cross member, wherein the at least one foot includes a first foot and a second foot provided on the first cross member and a third foot and a fourth foot provided on the second cross member, wherein the elevation mechanism includes a telescoping arm, and the upper frame element includes (i) a tubular peripheral portion having a first distal end and a second distal end, the first distal end of the upper frame element being connected to the upper distal end of the first central rail to form a first movable connection the second distal end of the upper frame element being connected to the upper distal end of the second central rail to form a second movable connection the first movable connection and the second movable connection constituting the first joint; and (ii) a longitudinal lever, the longitudinal lever including a first side integrally connected to the tubular peripheral portion and a second side pivotably connected to the telescoping arm, the second side being closer to the external stabilization structure than the first side, wherein the upper frame element includes (i) a first cross member connecting two sides of the tubular peripheral portion, the first cross member being disposed proximate to the first distal end and the second distal end of the tubular peripheral portion;

(ii) a longitudinal element for reinforcing the upper frame element, the longitudinal element being connected to the first cross member and the tubular peripheral portion; and (iii) a connection piece, wherein the tubular peripheral portion, the first cross member, and the longitudinal element are arranged in a common plane, and wherein the longitudinal element, the longitudinal lever, and the connection piece are arranged to form a rigid triangle.

6. The articulated mattress according to claim 5, wherein the upper frame element includes a second cross member connecting two sides of the tubular peripheral portion.

7. An articulated mattress comprising:

a mattress body including a cushion;

an elevation mechanism;

an internal support structure supporting the cushion, the internal support structure being disposed inside the mattress body and including an upper frame element, a lower frame element, and a central frame element connected to the upper frame element by a first joint and connected to the lower frame element by a second joint, the central frame element including at least two supports for pivotably fixing the elevation mechanism to the central frame element; and an external stabilization structure disposed outside the mattress body for supporting the articulated mattress, wherein the central frame element is removably connected to the external stabilization structure by at least one foot, wherein the elevation mechanism is configured such that the upper frame element and the lower frame element are independently movable, wherein the central frame element of the internal support structure includes (i) a first central rail having an upper distal end and a lower distal end;

(ii) a second central rail having an upper distal end and a lower distal end; and (iii) a first cross member and a second cross member, each of the first cross member and the second cross member connecting the first central rail to the second central rail so as to reinforce the central frame element, wherein the at least two supports for pivotably fixing the elevation mechanism to the central frame element include a first support on the first cross member and a second support on the second cross member, wherein the at least one foot includes a first foot and a second foot provided on the first cross member and a third foot and a fourth foot provided on the second cross member, wherein the elevation mechanism includes a telescoping arm, and the lower frame element includes (i) a peripheral portion having a first distal end and a second distal end, the first distal end being connected to the lower distal end of the first central rail to form a first movable connection the second distal end being connected to the lower distal end of the second central rail to form a second movable connection the first movable connection and the second movable connection constituting the second joint; and (ii) a tilted longitudinal lever, the tilted longitudinal lever including a first side integrally connected to one of the peripheral portion and a first cross member, the tilted longitudinal lever including a second side pivotably connected to the telescoping arm, wherein the peripheral portion of the lower frame element includes a bottom-lower frame element and an intermediate-lower frame element, the bottom-lower frame element being movable relative to the intermediate-lower frame element, wherein the lower frame element includes a first connection and a second connection, the first connection and the second connection constituting a third joint connecting the bottom-lower frame element to the intermediate-lower frame element, one of the first connection and the second connection including a stop, and wherein the tilted longitudinal lever being connected to the intermediate-lower frame element, the second side of the tilted longitudinal lever being disposed closer to both the central frame element and the external stabilization structure than the first side of the titled longitudinal lever.

* * * * *